US005387022A

United States Patent [19]

Soumah

[11] Patent Number: 5,387,022

[45] Date of Patent: Feb. 7, 1995

[54] PACK FOR FOOD PRODUCTS IN PORTIONS

[75] Inventor: Caroline Soumah, Beauvais, France

[73] Assignee: Nestec S.A., Vevey, Switzerland

[21] Appl. No.: 68,627

[22] Filed: May 27, 1993

[30] Foreign Application Priority Data

Jun. 29, 1992 [EP] European Pat. Off. ..... 92110951

[51] Int. Cl.[6] ..... A47G 23/06; B65D 1/36

[52] U.S. Cl. ..... 294/159; 294/172; 206/557

[58] Field of Search ..... 294/61, 144, 146, 159, 294/160, 172; 206/551, 557, 558, 561, 565

[56] References Cited

U.S. PATENT DOCUMENTS

| | | | |
|---|---|---|---|
| 665,142 | 1/1901 | Steinau | 206/557 |
| 1,541,672 | 6/1925 | Tulay | 294/172 X |
| 3,143,059 | 8/1964 | Sofio | 206/565 X |
| 3,848,943 | 11/1974 | Geesaman et al. | 206/561 X |
| 3,913,778 | 10/1975 | Oglesbee | 294/159 X |
| 4,874,083 | 10/1989 | Antoni et al. | 206/557 X |
| 5,139,299 | 8/1992 | Smith | 294/159 |

FOREIGN PATENT DOCUMENTS

| | | | |
|---|---|---|---|
| 369080 | 3/1932 | United Kingdom | 294/159 |

*Primary Examiner*—Dean J. Kramer
*Attorney, Agent, or Firm*—Vogt & O'Donnell

[57] ABSTRACT

A package assembly for containing a plurality of product portions has a protective shell and a product portion support element which is covered by the shell and which has a stem which extends through the shell for being gripped. The support element has a base having spaced-apart shaped plate portions which extend from a central base portion which form a planar base surface. The stem is connected to and extends perpendicularly from a centrally disposed portion of the base surface. The covering shell has a sidewall portion which extends from an edge which circumscribes a shell base opening configured in an outline shape of the shaped plates for being positioned adjacent the plates for encompassing food product portions positioned on the plates. A shell cover portion extends from the cover sidewall at a position displaced from the edge and opposes the shell base opening for covering the base and portions on the base and has an opening which is engageable with the stem, the covering shell and stem being configured so that the stem extends through the cover portion opening so that the stem may be gripped.

14 Claims, 3 Drawing Sheets

PACK FOR FOOD PRODUCTS IN PORTIONS

BACKGROUND OF THE INVENTION

This invention relates to a pack for food products in portions.

The problem addressed by the present invention was to provide a pack for food products to be sprinkled. For example, ice creams presented in the form of portions may be sprinkled with cocoa powder. In this case, the ice cream portion is picked up with the fingers after sprinkling and placed in its pack which has the effect of leaving finger marks on the portion. Accordingly, it would be of advantage to have a pack for products of this type with which any manual contact with the portion could be avoided.

It is also understood that, after sprinkling, the pack should allow mechanical handling of the ice cream portions thus produced. Accordingly, the pack according to the invention eliminates the need for manual contact after sprinkling and enables the portions to advance along a production line.

SUMMARY OF THE INVENTION

The present invention provides a pack for food products in portions comprising a support element in the form of a gripping stem, and a base which has at least two space-apart plates for the portions and which is fixed to the bottom of the stem perpendicularly thereof and comprising a protective shell which surrounds the plates forming a space for the portions and providing an opening in which the top of the gripping stem engages.

DETAILED DESCRIPTION OF THE INVENTION

The pack according to the invention is designed for any food product to be sprinkled, such as ice cream, cake and the like, and the sprinkling product is either cocoa powder, sugar or flour.

When the portions of food product have been deposited on the plates, it is important that, when the protective shell is applied, it does not touch the portions. To this end, centering lugs are provided on the top of the gripping stem to cooperate with corresponding recesses in the protective opening.

It is important that the space between the successive plates of the support element is hollow.

The support element comprises between 2 and 6 plates arranged symmetrically in relation to the gripping stem. The support element preferably comprises four plates, in which case four centering lugs are provided.

The protective shell forms spaces above the plates for the portions of food products. The shell forms as many spaces as there are plates on the support element.

To strengthen the support element, it is advisable to provide reinforcing ribs for each plate positioned radially on the plate and extending longitudinally from the plate to the gripping stem. It may even be of advantage for the rib to extend partly onto the gripping stem, in which case, the centering lug is situated in the extension of that rib.

The gripping stem is normally cylindrical or frustoconical in shape or of parallelepipedic cross-section.

If the pack is to be used for ice creams, the portions are either shaped, hardened and then placed on each plate of the support element or are directly formed on the plates and then hardened.

The support element is then moved into the sprinkling tunnel. The shape of the plates enables the powder to be deposited solely onto the product and not onto the pack. After sprinkling, it is sufficient to cover the portions with the protective shell. The presence of the opening and the recesses in the shell enable it to be centered relative to the support element.

The whole pack is then raised by the gripping stem and placed in a carton.

Since each portion is deposited onto a corresponding plate, it is important that the portion remains firmly in place. To this end, between one and six holding pins must be provided on the plates. It has been found that two pins correctly hold the portions on the plates and facilitate handling by the consumer.

The holding pins are substantially conical in shape and have a height of 4 to 10 mm and preferably 7 mm.

The portions deposited on to the support element are normally spherical or cylindrical in shape so that the plates will be circular in shape although other shapes are of course possible.

The support element and the protective shell are made by injection moulding or by thermoforming from a material which is compatible with foods, for example polystyrene, polypropylene, polyethylene, polyethylene terephthalate, polycarbonate or polyvinyl chloride. The support element should be rigid, whereas the protective shell may be less thick and more flexible.

The pack will typically be a substantially clover-shaped four-portion pack.

The invention is described in more detail in the following with reference to the accompanying drawings.

DETAILED DESCRIPTION OF THE DRAWINGS

Figure 1:
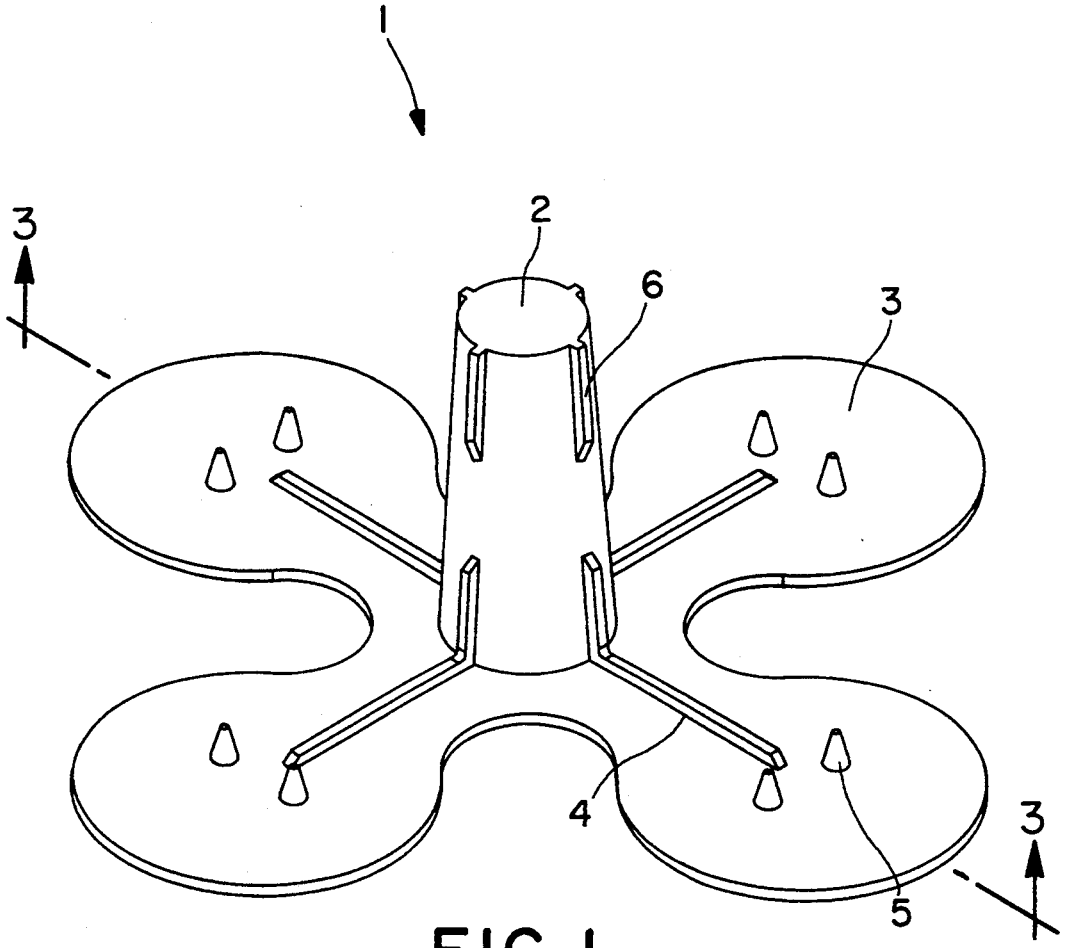
FIG. 1 is a perspective view of the support element.

The support element (1) comprises a gripping stem (2) and a base having spaced-apart shaped plate portions (3) which extend from a central base portion. The central and plate base portions form a planar base surface, and as illustrated, the base has a form of a four-leaf clover. The stem (2), as illustrated, is connected to and extends from a centrally disposed portion of the base surface so that a central longitudinal axis of the stem extends in a direction perpendicular to the base surface. As illustrated, the reinforcing ribs (4) project from the base surface, and these ribs extend longitudinally from each plate portion in a direction to the stem and, as illustrated, onto the stem and thereby, are positioned on the base surface radially. As also illustrated, two holding pins (5) project from the base surface of each plate portion. The top of the gripping stem comprises centering lugs (6) which project from the stem and extend longitudinally in a direction transverse to the planar base surface.

Figure 2:
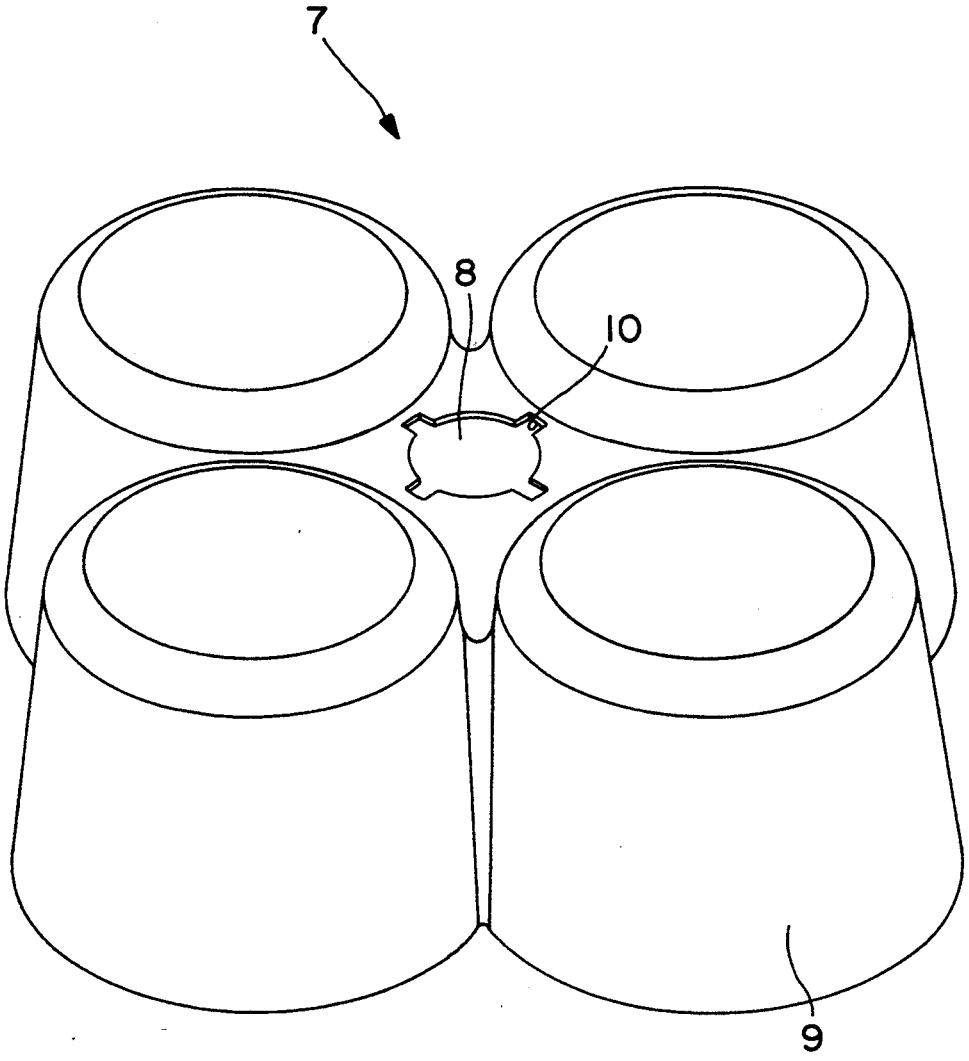
FIG. 2 is a perspective view of the protective shell.
Figure 3:
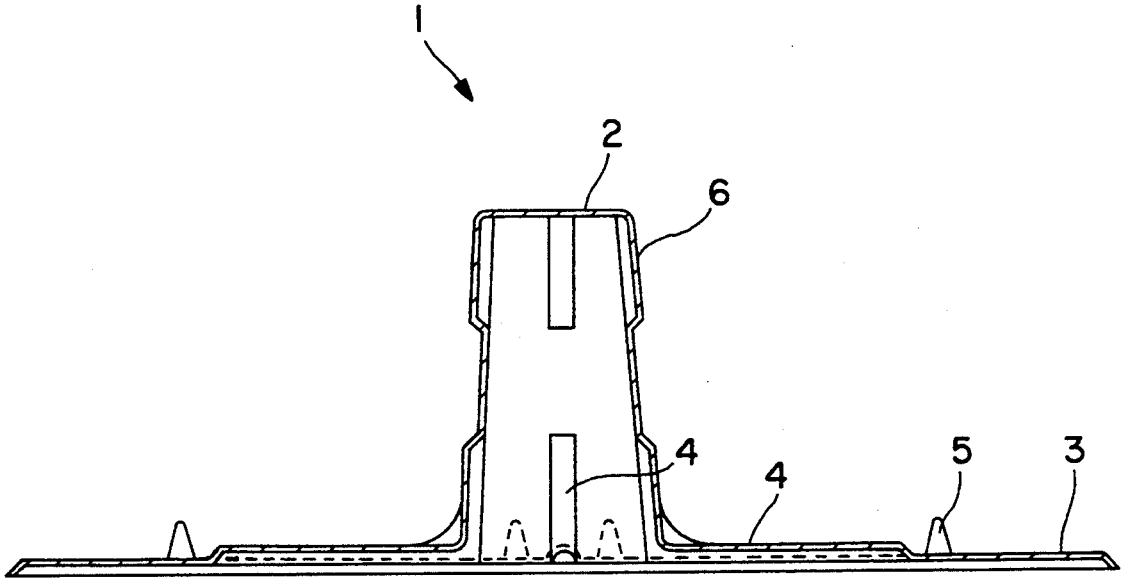
FIG. 3 is a section on the line 1—1 in FIG 1.

The protective shell (7) (FIG. 2) comprises four recesses (9) forming a space for the portions of ice cream covered with cocoa powder. The central opening (8) with its recesses (10) enables the shell to be centered relative to the support element by the lugs (6). Thus, to form the space for the portions, as illustrated, the covering shell has a sidewall portion, which extends from an edge which circumscribes a shell base opening, and has a cover portion which extends from the sidewall at a position displaced from the edge and opposes the shell base opening and which has a centrally disposed opening for engaging the stem. As also described above and in the context of FIGS. 1 and 2, the sidewall and shell base opening are configured in an outline shape of the shaped plates for being positioned adjacent the plates for encompassing food product portions positioned on the plate portions, and the stem and sidewall each extend for a distance sufficient to provide a space between the base surface and cover portion for containing food product portions positioned on the base surface of the plate portions and so that the stem extends for a distance sufficient so that the stem extends through the cover opening for being gripped. As further described above, when the stem has lugs (6) and the covering shell opening (8) includes opening recess areas (10), the recess areas are positioned and configured for engaging the lugs for positioning the shell relative to the stem and plate portions.

The support element normally has a diameter of 18 to 20 cm while the gripping stem has a height of 6 to 8 cm and a diameter of 2 to 3 cm. The holding pins have a height of 7 mm. The retaining shell has a height of 6 to 8 cm.

The invention thus provides a highly reliable, lightweight and compact pack of pleasant appearance. It may be placed as such on the table of the consumer.

I claim:

1. A package assembly for containing a food product in portions comprising:

a support element comprising a base and a stem wherein the base has a central base portion and at least two shaped plate portions which extend from the central base portion and which are spaced-apart and separated by open space therebetween and wherein the central base portion and plate portions form a planar base surface and wherein the stem is connected to and extends from a centrally disposed portion of the base surface so that a central longitudinal axis of the stem extends in a direction perpendicular to the base surface;

a covering shell comprising a sidewall portion and a cover portion wherein the sidewall portion has a sidewall edge which circumscribes a shell base opening and is configured in an outline shape of the plate portions for being positioned adjacent the plate portions for encompassing food product portions positioned on the base surface of the plate portions and wherein the cover portion extends from the sidewall portion at a position displaced from the sidewall edge and opposes the shell base opening and has a centrally disposed opening defined by a cover portion edge shaped for engaging the stem, and wherein the sidewall portion extends for a distance sufficient to provide, upon the shell being positioned so that the cover portion shaped edge engages the stem and so that the sidewall edge is positioned adjacent the plate portions, a space between the base surface and cover portion for encompassing food product portions positioned on the base surface of the plate portions; and wherein the stem extends for a distance so that, upon the shell being positioned so that the cover portion shaped edge engages the stem and so that the sidewall edge is positioned adjacent the plate portions, the stem extends through the cover portion opening for a distance sufficient for being gripped.

2. A package assembly according to claim 1 wherein the support element further comprises pins which project from the base surface of each plate portion for holding a food product portion in place on the base surface of the plate portions.

3. A package assembly according to claim 1 or 2 wherein the support element further comprises lugs which project from the stem and extend longitudinally in a direction transverse to the planar base surface and which are positioned so that, upon the shell being positioned so that the cover portion shaped edge engages the stem and so that the sidewall edge is positioned adjacent the plate portions, the lugs extend through the cover portion opening and wherein the cover portion shaped edge has recess areas positioned and configured for engaging the lugs for positioning the covering shell relative to the stem and plate portions.

4. A package assembly according to claim 3 wherein the support element further comprises ribs which project from the base surface and which extend longitudinally from each plate portion in a direction to the stem for strengthening the support element.

5. A package assembly according to claim 4 wherein the ribs are positioned on the base surface radially and extend onto the stem.

6. A package assembly according to claim 1 or 2 wherein the support element further comprises ribs which project from the base surface and which extend longitudinally from each plate portion in a direction to the stem for strengthening the support element.

7. A package assembly according to claim 6 wherein the ribs are positioned on the base surface radially and extend onto the stem.

8. A package assembly according to claim 2 wherein each plate portion has two pins.

9. A package assembly according to claim 2 wherein the pins are conical in shape.

10. A package assembly according to claim 2 wherein the pins extend from the base surface for a distance of from 4 mm to 10 mm.

11. A package assembly according to claim 1 wherein the outline shape of the plate portions is curved.

12. A package assembly according to claim 1 wherein there are four plate portions.

13. A package assembly according to claim 1 wherein the stem is frustoconical in shape.

14. A package assembly according to claim 1 wherein the support element and covering shell are made of a material selected from the group consisting of polystyrene, polypropylene, polyethylene, polyethylene terephthalate, polycarbonate and polyvinyl chloride.

* * * * *